US009682297B2

(12) United States Patent
Lorentzen et al.

(10) Patent No.: US 9,682,297 B2
(45) **Date of Patent: *Jun. 20, 2017**

(54) GOLF CLUB HEAD

(71) Applicant: Taylor Made Golf Company, Inc., Carlsbad, CA (US)

(72) Inventors: John Francis Lorentzen, El Cajon, CA (US); Bing-Ling Chao, San Diego, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/255,599

(22) Filed: Sep. 2, 2016

(65) Prior Publication Data

US 2016/0367870 A1 Dec. 22, 2016

Related U.S. Application Data

(63) Continuation of application No. 14/699,905, filed on Apr. 29, 2015, now Pat. No. 9,457,243, which is a (Continued)

(51) Int. Cl.
*A63B 53/04* (2015.01)

(52) U.S. Cl.
CPC ..... *A63B 53/0466* (2013.01); *A63B 53/04* (2013.01); *A63B 2053/0408* (2013.01); (Continued)

(58) Field of Classification Search
CPC ..... A63B 53/0466; A63B 53/04; A63B 2053/0408; A63B 2053/0412; (Continued)

(56) References Cited

U.S. PATENT DOCUMENTS 1,133,129 A 3/1915 Govan
3,567,228 A 3/1971 Lynn
(Continued)

FOREIGN PATENT DOCUMENTS

GB 2 338 903 1/2000
JP U-H05-068564 9/1993
(Continued)

OTHER PUBLICATIONS

Japanese Office action (English translation), Japanese App. No. 2005-123040, filed Apr. 21, 2005, 3pp. (Aug. 3, 2010).

*Primary Examiner* — Benjamin Layno
(74) *Attorney, Agent, or Firm* — Klarquist Sparkman, LLP

(57) ABSTRACT

A golf club head is described having a club head body having an external surface with a heel portion, a toe portion, a crown portion, a sole portion, and a front opening. The golf club head also includes a face insert support structure located at the front opening. The support structure includes a rear support member. The rear support member includes a support portion interior surface contour defining an apex point and an undercut distance in an undercut region within at least one major or minor plane. A non-undercut region is located in at least one major or minor plane intersecting the crown to face transition region.

19 Claims, 11 Drawing Sheets

Related U.S. Application Data continuation of application No. 13/793,988, filed on Mar. 11, 2013, now Pat. No. 9,028,341.

(52) U.S. Cl.
CPC ..... *A63B 2053/0412* (2013.01); *A63B 2053/0416* (2013.01); *A63B 2053/0433* (2013.01); *A63B 2053/0437* (2013.01); *A63B 2053/0445* (2013.01)

(58) Field of Classification Search
CPC .... A63B 2053/0416; A63B 2053/0433; A63B 2053/0437; A63B 2053/0445
USPC ..... 473/342, 345, 349, 350, 329
See application file for complete search history.

(56) References Cited

U.S. PATENT DOCUMENTS

| | | | |
|---|---|---|---|
| 3,695,618 | A | 10/1972 | Woolley et al. |
| 4,804,188 | A | 2/1989 | McKee et al. |
| 4,884,812 | A | 12/1989 | Nagasaki et al. |
| 5,106,094 | A | 4/1992 | Desbiolles et al. |
| 5,261,664 | A | 11/1993 | Anderson |
| 5,344,140 | A | 9/1994 | Anderson |
| 5,346,216 | A | 9/1994 | Aizawa |
| 5,433,440 | A | 7/1995 | Lin |
| 5,480,153 | A | 1/1996 | Igarashi |
| 5,494,281 | A | 2/1996 | Chen |
| 5,505,453 | A | 4/1996 | Mack |
| 5,518,242 | A | 5/1996 | Mahaffey et al. |
| 5,720,673 | A | 2/1998 | Anderson |
| 5,766,094 | A | 6/1998 | Mahaffey et al. |
| 5,774,970 | A | 7/1998 | Huang |
| 5,830,084 | A | 11/1998 | Kosmatka |
| 5,906,550 | A | 5/1999 | Kingston |
| 5,993,329 | A | 11/1999 | Shieh |
| 6,050,904 | A | 4/2000 | Kuo |
| 6,162,133 | A | 12/2000 | Peterson |
| 6,193,614 | B1 | 2/2001 | Sasamoto et al. |
| 6,248,025 | B1 | 6/2001 | Murphy et al. |
| 6,364,789 | B1 | 4/2002 | Kosmatka |
| 6,390,932 | B1 | 5/2002 | Kismatka et al. |
| 6,440,011 | B1 | 8/2002 | Hocknell et al. |
| 6,582,323 | B2 | 6/2003 | Soracco et al. |
| 6,607,451 | B2 | 8/2003 | Kosmatka et al. |
| 6,648,774 | B1 | 11/2003 | Lee |
| 6,669,576 | B1 | 12/2003 | Rice |
| 6,669,577 | B1 | 12/2003 | Hocknell et al. |
| 7,004,852 | B2 | 2/2006 | Billings |
| 7,357,730 | B2 | 4/2008 | Shieh |
| RE42,544 | E | 7/2011 | Chao et al. |
| 8,096,897 | B2 | 1/2012 | Beach et al. |
| RE43,801 | E | 11/2012 | Chao et al. |
| 9,028,341 | B2 * | 5/2015 | Lorentzen ..... A63B 53/04 473/329 |
| 9,457,243 | B2 * | 10/2016 | Lorentzen ..... A63B 53/04 |
| 2001/0055995 | A1 | 12/2001 | Cackett et al. |
| 2002/0065146 | A1 | 5/2002 | Kusumoto |
| 2003/0036442 | A1 | 2/2003 | Chao et al. |
| 2003/0139227 | A1 | 7/2003 | Sugimoto |
| 2005/0026718 | A1 | 2/2005 | Chen |
| 2005/0239575 | A1 | 10/2005 | Chao et al. |
| 2008/0064525 | A1 | 3/2008 | Murphy et al. |

FOREIGN PATENT DOCUMENTS

| | | |
|---|---|---|
| JP | 09-299519 | 11/1997 |
| JP | 10-155943 | 6/1998 |
| JP | 2002315854 | 10/2002 |

* cited by examiner

GOLF CLUB HEAD

CROSS-REFERENCE TO RELATED APPLICATION

This application is a continuation of U.S. patent application Ser. No. 14/699,905, filed Apr. 29, 2015, now U.S. Pat. No. 9,457,243 which is a continuation of U.S. patent application Ser. No. 13/793,988, filed Mar. 11, 2013, now U.S. Pat. No. 9,028,341 which are incorporated herein by reference in their entireties.

FIELD

The present disclosure relates to a golf club head. More specifically, the present disclosure relates to a non-undercut and undercut face support structure.

BACKGROUND

Golf is a game in which a player, using many types of clubs, hits a ball into each hole on a golf course in the lowest possible number of strokes. Golf club head manufacturers and designers seek to improve certain performance characteristics such as forgiveness, playability, feel, and sound. In addition, the durability of the golf club head must be maintained while the performance characteristics are enhanced.

The United States Golf Association (USGA) regulations constrain golf club head shapes, sizes, and moments of inertia. Due to theses constraints, golf club manufacturers and designers struggle to produce a club having maximum size and moment of inertia characteristics while maintaining all other golf club head characteristics, such as weight and sufficient durability.

SUMMARY

The foregoing and other objects, features, and advantages of the invention will become more apparent from the following detailed description, which proceeds with reference to the accompanying figures.

According to one aspect of the present invention, a golf club head is described having a club head body having an external surface with a heel portion, a toe portion, a crown portion, a sole portion, and a front opening. The golf club head also includes a face insert support structure located at the front opening. The support structure includes a rear support member. The rear support member includes a support portion interior surface contour defining an apex point and an undercut distance in an undercut region within at least one major or minor plane. The face insert is attached at the front opening and closes the front opening of the body. At least one non-undercut region is located in at least one major or minor plane intersecting the crown to face transition region.

According to another aspect of the present invention, the golf club head includes four major planes that intersect at a geometric center point of the face creating eight pie shaped major regions. The non-undercut region is located within two to seven of the eight pie shaped major regions.

According to yet another aspect of the present invention, the golf club head includes a non-undercut region that is located within four to seven of the eight pie shaped major regions. The face insert prepreg plies has a face thickness of about 4.5 mm or less. The golf club head has a coefficient of restitution of at least 0.79 and a characteristic time of less than at least 257 μs. The non-undercut region includes a first non-undercut region and a second non-undercut region that are separated by at least one undercut region. The first non-undercut region is located substantially in a crown region and creates a non-undercut zone having a zone angle that is between 5° and 175°. The second non-undercut region is located substantially in a sole region and creates a non-undercut zone having a zone angle that is between 5° and 175°. An adjustable loft, lie, or face angle system that is capable of adjusting the loft, lie, or face angle that is included proximate to the second non-undercut region that is located substantially in the sole region.

According to one aspect of the present invention, the golf club head has a weight of between 185 g and 215 g, and the non-undercut zone is centered about a major vertical plane. The volume of the golf club head is between 400 cc and 475 cc.

The golf club head includes a CG x-axis coordinate is between −5 mm and 10 mm, a CG y-axis coordinate is between 20 mm and 50 mm, and a CG z-axis coordinate is between −10 mm and 5 mm. The rear support member includes a heel-side rear support member that is integral with an internal hosel tube structure. Furthermore, the golf club head includes a moment of inertia about the golf club head CG z-axis is between 370 $kg \cdot mm^2$ and 430 $kg \cdot mm^2$, a moment of inertia about the golf club head CG x-axis is between 160 $kg \cdot mm^2$ and 320 $kg \cdot mm^2$, and a moment of inertia about the golf club head CG y-axis is between 270 $kg \cdot mm^2$ and 350 $kg \cdot mm^2$. The golf club head includes an undercut distance is between 0 mm and 20 mm and an undercut height that is between 1 mm and 20 mm.

According to yet another aspect of the present invention, a golf club head is described having an external surface with a heel portion, a toe portion, a crown portion, a sole portion, and a front opening. A face insert support structure is located at the front opening. The support structure includes a rear support member. The rear support member includes a support portion interior surface contour defining a non-undercut region. The non-undercut region is one of a plurality of non-undercut regions within a plurality of major or minor planes. A face insert is attached at the front opening and closes the front opening of the body. At least one crown-side non-undercut zone is defined by the plurality of non-undercut regions in the crown portion. In addition, at least one sole-side non-undercut zone is defined by the plurality of non-undercut regions in the sole portion. At least one crown-side non-undercut zone angle is associated with the at least one crown-side non-undercut zone. Furthermore, at least one sole-side non-undercut zone angle is associated with the sole-side non-undercut zone. A summation of the crown-side non-undercut zone angle and a summation of the sole-side non-undercut zone angle defines a crown-to-sole non-undercut ratio. The summation of the at least one crown-side non-undercut zone angle divided by the summation of the at least one sole-side non-undercut zone angle satisfies the following equation:

$$\frac{\sum \text{Crown-Side Non-Undercut Zone Angle}}{\sum \text{Sole-Side Non-Undercut Zone Angle}} \leq 1.$$

The crown-side non-undercut zone is spaced apart from the sole-side non-undercut zone angle by at least one undercut zone. The crown-to-sole non-undercut ratio is between 0.05 and 0.95 or is between 0.40 and 0.60.

According to yet another aspect of the present invention a golf club head is described including a club head body having an external surface with a heel portion, a toe portion, a crown portion, a sole portion, and a front opening. A face insert support structure is located at the front opening. The support structure includes a rear support member. The rear support member has a support portion interior surface contour defining an undercut region. The undercut region is one of a plurality of undercut regions within a plurality of major or minor planes. At least one heel-side undercut zone is defined by the plurality of undercut regions in the heel portion and at least one toe-side undercut zone being defined by the plurality of undercut regions in the toe portion. At least one heel-side undercut zone angle is associated with the heel-side undercut zone. At least one toe-side non-undercut zone angle is associated with the toe-side undercut zone. A summation of the at least one heel-side undercut zone angle and a summation of the at least one toe-side undercut zone angle define a heel-to-toe undercut ratio. The heel-to-toe undercut ratio is between 0.05 and 0.95 or between 0.30 and 0.70.

The summation of the at least one heel-side undercut zone angle divided by the summation of the at least one toe-side undercut zone angle satisfies the following equation:

$$\frac{\sum \text{heel-side undercut zone angle}}{\sum \text{toe-side undercut zone angle}} \leq 1.$$

DETAILED DESCRIPTION

Various embodiments and aspects of the inventions will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions.

Embodiments of a golf club head providing a face insert support structure are described herein. In some embodiments, the golf club head has a desired shape for providing maximum golf shot forgiveness given a maximum head volume, a maximum head face area, and a maximum head depth according to desired values of these parameters, and allowing for other considerations such as the physical attachment of the golf club head to a golf club and golf club aesthetics.

Figure 1A:
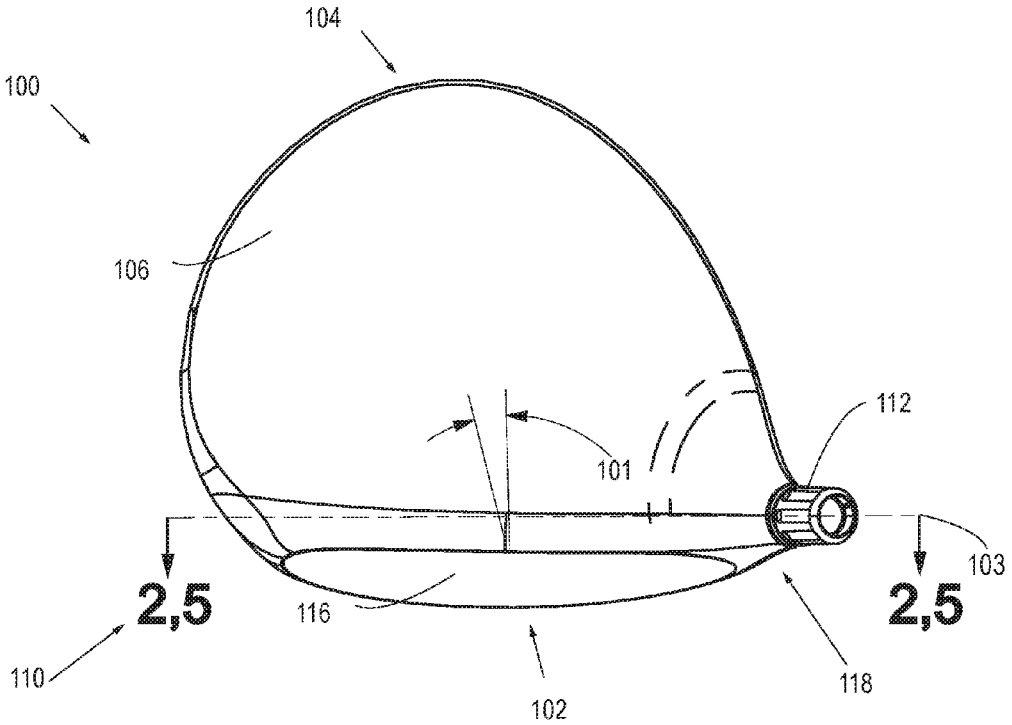
FIG. 1A is a top view of a golf club head.

FIG. 1A illustrates a wood-type (e.g., driver or fairway wood) golf club head from a top view of the club head 100 with a face insert. The club head 100 includes a front portion 102, a back portion 104, a heel portion 118, a toe portion 110, a striking surface 116, a hosel 112, and a crown portion 106. The club head 100 also includes a face angle 101 when at an address position. A hosel plane 103 is shown which contains a hosel axis 105. For ease of illustration, striking face score lines are excluded from this view.

Figure 1B:
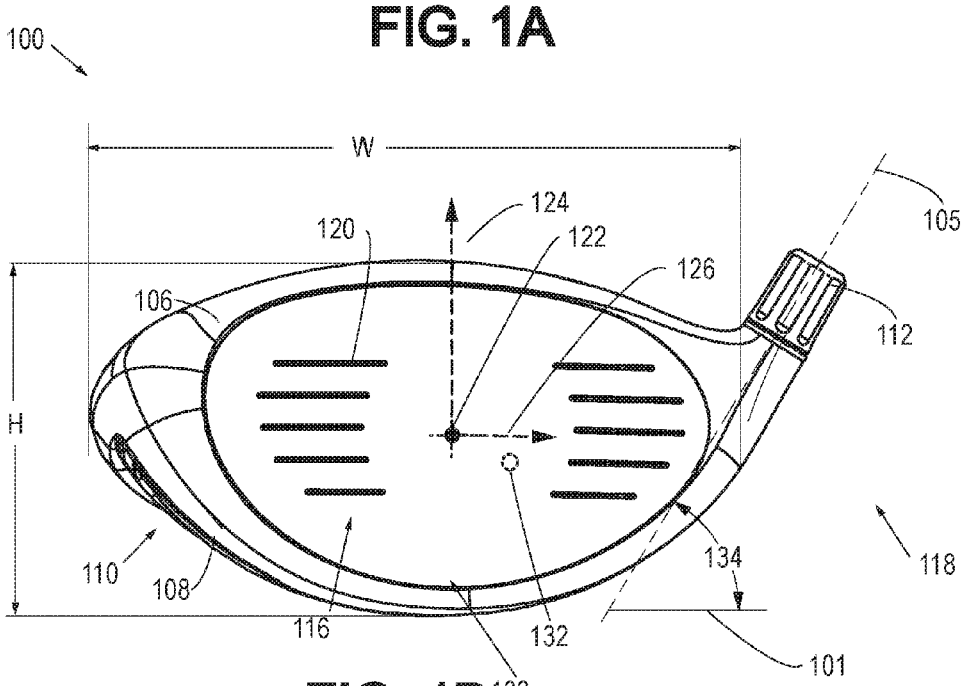
FIG. 1B is an elevated front view of the golf club head in FIG. 1A showing a golf club head origin coordinate system and a center of gravity according to one embodiment.

FIG. 1B shows the club head 100 from a front view at an address position including a hollow body having a crown portion 106, a sole portion 108, and a front portion 102. The club head 100 also includes a hosel 112 which defines a hosel bore defining a hosel axis 105 and is connected with the hollow body. The hollow body further includes a heel portion 118 and a toe portion 110. A striking surface 116 is located on the front portion 102 of the golf club head 100 having score lines or markings 120. In some embodiments, the striking surface 116 can include a bulge and roll curvature or a face insert. In some embodiments of the present invention, the striking surface 116 is at least partially made of a composite material as described in U.S. patent application Ser. No. 10/442,348 (now U.S. Pat. No. 7,267,620), Ser. No. 10/831,496 (now U.S. Pat. No. 7,140,974), Ser. Nos. 11/642,310, 11/825,138, 11/998,436, 11/895,195, 11/823,638, 12/004,386, 12,004,387, 11/960,609, 11/960,610, and 12/156,947, which are incorporated herein by reference in their entirety. The composite material can be manufactured according to the methods described at least in U.S. patent application Ser. No. 11/825,138. A polymer coating can be applied to the composite material as described in the above identified U.S. Patent Applications.

In other embodiments, the striking surface 116 is at least partially made from a metal alloy (e.g., titanium, steel, aluminum, and/or magnesium), ceramic material, or a combination of composite, polymer, metal alloy, and/or ceramic materials. Moreover, the striking face 116 can be a striking plate having a variable thickness as described in U.S. Pat. Nos. 6,997,820, 6,800,038, 6,824,475, and 7,066,832 which are incorporated herein by reference. For example, the face insert can have a total thickness that is within a range of about 1 mm to about 8 mm. The face insert can be made of prepreg plies having a fiber areal weight of less than 100 $g/m^2$.

Figure 1C:
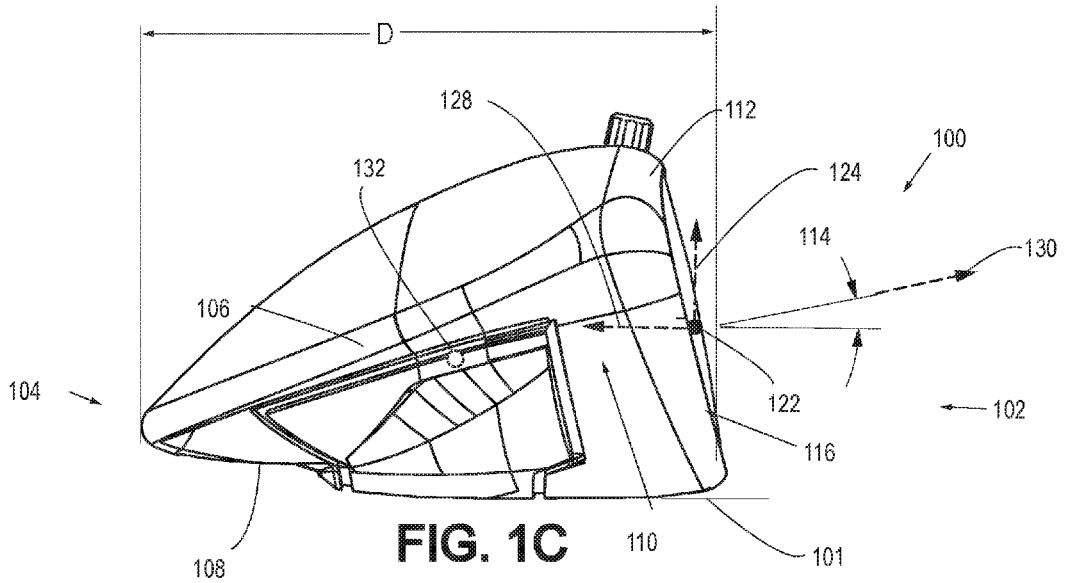
FIG. 1C is an elevated toe view of the golf club head in FIG. 1A.

FIGS. 1B and 1C generally show a club head origin coordinate system being provided such that the location of various features of the club head (including, e.g., a club head CG) can be determined. In FIGS. 1B and 1C, a club head origin point 122 is represented on the club head 100. The club head origin point 122 is positioned at the ideal impact location which can be a geometric center of the striking surface 116.

The head origin coordinate system is defined with respect to the head origin point 122 and includes a Z-axis 124, an X-axis 126, and a Y-axis 128. The Z-axis 124 extends through the head origin point 122 in a generally vertical direction relative the ground 101 when the club head 100 is at an address position (although the Z-axis 124, X-axis 126, and Y-axis 128 are independent of club head 100 orientation). Furthermore, the Z-axis 124 extends in a positive direction from the origin point 122 in an upward direction.

The X-axis 126 extends through the head origin point 122 in a toe-to-heel direction substantially parallel or tangential to the striking surface 116 at the origin point 122. The X-axis 126 extends in a positive direction from the origin point 122 to the heel 118 of the club head 100 and is perpendicular to the Z-axis 124 and Y-axis 128.

The Y-axis 128 extends through the head origin point 122 in a front-to-back direction and is generally perpendicular to the X-axis 126 and Z-axis 124. The Y-axis 128 extends in a positive direction from the origin point 122 towards the rear portion or back portion 104 of the club head 100.

Referring to FIGS. 1B and 1C, the golf club heads described herein each have a maximum club head height (H, top-bottom), width (W, heel-toe) and depth (D, front-back). The maximum height, H, is defined as the distance between the lowest and highest points on the outer surface of the golf club head body measured along an axis parallel to the origin Z-axis 124 when the club head is at a proper address position. The maximum depth, D, is defined as the distance between the forward-most and rearward-most points on the surface of the body measured along an axis parallel to the origin Y-axis 128 when the head is at a proper address position. The maximum width, W, is defined as the distance between the farthest distal toe point and closest proximal heel point on the surface of the body measured along an axis parallel to the origin X-axis 126 when the head is at a proper address position. FIG. 1B further shows a lie angle 134 between a hosel axis 124 and a level ground surface 101 when the head 100 is at a proper address position. FIG. 1C shows the striking surface 116 having a face normal vector 130 that forms a face loft angle 114. The face normal vector 130 intersects the origin point 122 and extends in a positive direction away from the club head body. The face normal vector 130 is perpendicular to a plane that is tangent to the origin point 122.

The height, H, width, W, and depth D of the club head in the embodiments herein are measured according to the United States Golf Association "Procedure for Measuring the Club Head Size of Wood Clubs" revision 1.0 and Rules of Golf, Appendix II(4)(b)(i).

Golf club head moments of inertia are defined about three axes extending through the golf club head CG 132 including: a CG z-axis extending through the CG 132 in a generally vertical direction relative to the ground 101 when the club head 100 is at address position, a CG x-axis extending through the CG 132 in a heel-to-toe direction generally parallel to the origin X-axis 126 and generally perpendicular to the CG z-axis, and a CG y-axis extending through the CG 132 in a front-to-back direction and generally perpendicular to the CG x-axis and the CG z-axis. The CG x-axis and the CG y-axis both extend in a generally horizontal direction relative to the ground 101 when the club head 100 is at the address position. In other words, the CG x-axis and CG y-axis lie in a plane parallel to the ground 101. Specific CG location values are discussed in further detail below with respect to certain exemplary embodiments.

The moment of inertia about the golf club head CG x-axis is calculated by the following equation:

$$I_{CGx}=\int(y^2+z^2)dm \qquad \text{Eq. 1}$$

In the above equation, y is the distance from a golf club head CG xz-plane to an infinitesimal mass, dm, and z is the distance from a golf club head CG xy-plane to the infinitesimal mass, dm. The golf club head CG xz-plane is a plane defined by the CG x-axis and the CG z-axis. The CG xy-plane is a plane defined by the CG x-axis and the CG y-axis.

Moreover, a moment of inertia about the golf club head CG z-axis is calculated by the following equation:

$$I_{GCx}=\int(x^2+y^2)dm \qquad \text{Eq. 2}$$

In the equation above, x is the distance from a golf club head CG yz-plane to an infinitesimal mass dm and y is the distance from the golf club head CG xz-plane to the infinitesimal mass dm. The golf club head CG yz-plane is a plane defined by the CG y-axis and the CG z-axis. Specific moment of inertia values for certain exemplary embodiments are discussed further below.

Figure 1D:
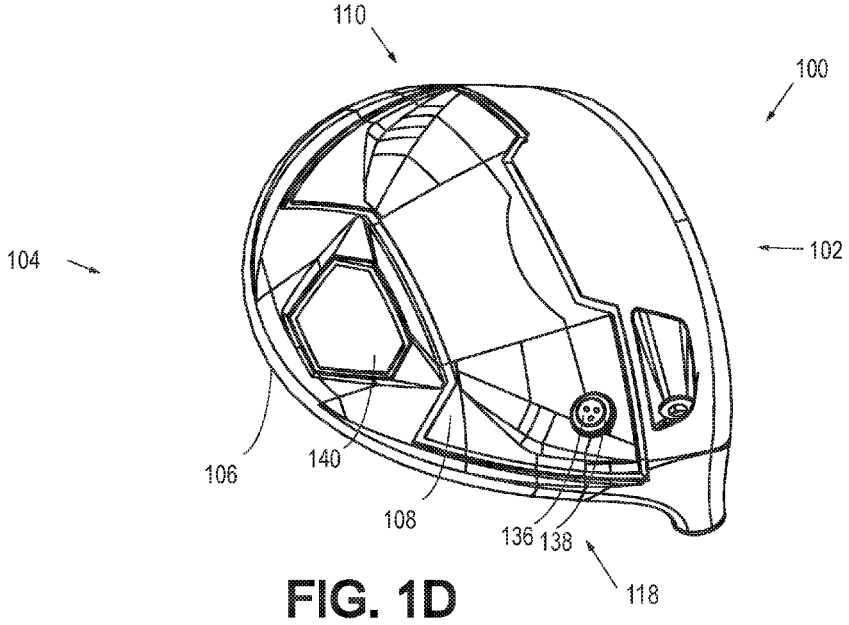
FIG. 1D is an isometric sole view of the golf club head in FIG. 1A.

FIG. 1D shows a sole view of an exemplary embodiment club head 100 including a front portion 102, a rear portion 104, a heel portion 118, a toe portion 110, a crown portion 106, and a sole portion 108. A movable weight 136 is located within a weight port 138 in the heel portion 118 of the sole 108. The movable weight 136 increases the MOI of the club head while lowering the CG location. In addition a badge 140 is located on the sole portion 108 of the club head near the rear portion 104 of the club head. The badge 140 contains identifying indicia such as the club head name, for example.

Figure 2:
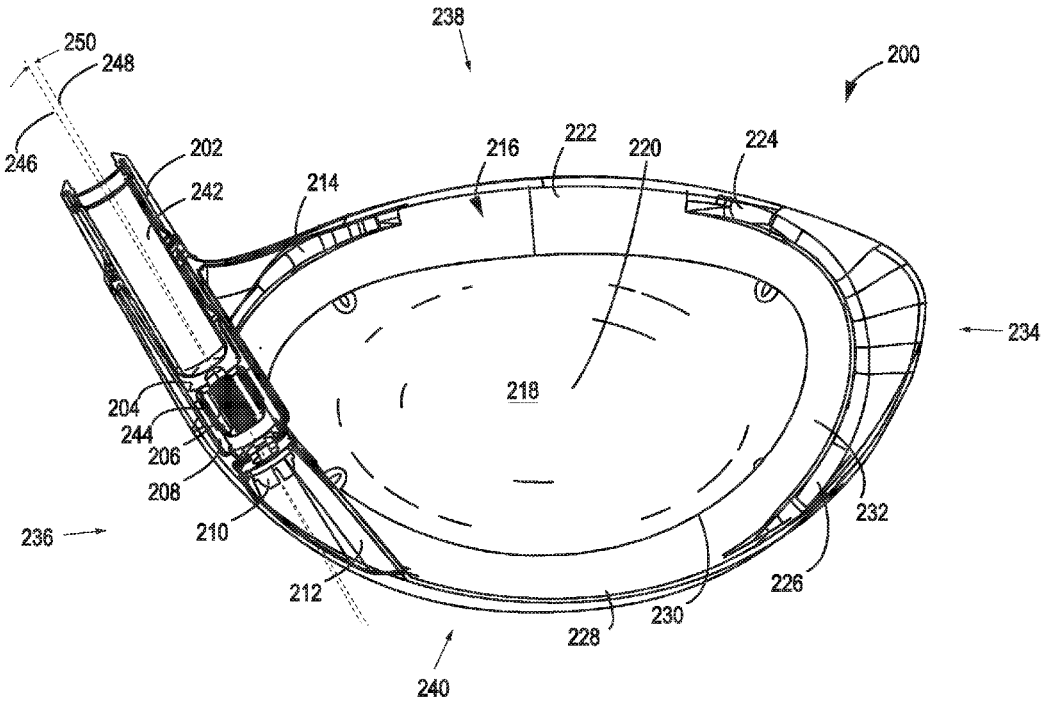
FIG. 2 is a cross-sectional view of an undercut and non-undercut structure taken along section lines 2-2 in FIG. 1A.

FIG. 2 illustrates a golf club head 200 sectional view when taken along section lines 2-2 in FIG. 1A showing a rear portion of the striking face and insert 218, a toe portion 234, a heel portion 236, a crown portion 238, and a sole portion 240. The striking face includes a front opening 230 having a face insert support structure 216 that includes a rear support member 232. The face insert 218 is attached at the front opening 230 and thereby closes the front opening of the body when the club head is fully assembled. In one embodiment, the face insert 218 has a variable thickness with a thickest portion 220 located near the geometric center of the face insert 218 and thinner face insert 218 portions located near the peripheral edges of the face insert 218. The rear support member 232 provides a ledge for which the face insert 218 is supported.

A toe undercut portion 226, 224 is located toward the toe portion 234 of the golf club head 200. A heel undercut portion 214 is located toward the heel portion 236. A crown non-undercut portion 222 is located toward a crown portion 238 and a sole non-undercut portion 228 is located toward a sole portion 240.

The toe undercut portion 226, 224 extends from a crown-side toe undercut portion 224 to a sole-side toe undercut portion 226. In one embodiment, the heel undercut portion 214 is located primarily near the crown portion 238 only as shown in FIG. 2. However, in another embodiment, the heel undercut portion 214 is located near the crown portion 238 and the sole portion 240, similar to the toe undercut portion 226, 224.

FIG. 2 further illustrates a removable shaft system having a ferrule 202, a sleeve bore 242 within a sleeve 204. A shaft is inserted into the sleeve bore 242 and is mechanically secured or bonded to the sleeve 204. The sleeve 204 further includes an anti-rotation portion 244 at a distal tip of the sleeve 204 and a threaded bore 206 for engagement with a screw 210 that is inserted into the sole opening 212 of the club head 200. In one embodiment, the sole opening 212 is directly adjacent to a sole non-undercut portion. The anti-rotation portion 244 of the sleeve 204 engages with an anti-rotation collar 208 which is bonded or welded within the hosel opening of the golf club head 200. The adjustable loft, lie, and face angle system is described in U.S. patent application Ser. No. 12/687,003 (now U.S. Pat. No. 8,303,431), which is incorporated by reference in its entirety.

The embodiment shown in FIG. 2 includes an adjustable loft, lie, or face angle system that is capable of adjusting the loft, lie, or face angle either in combination with one another or independently from one another. An adjustable sole piece may be used in combination with the adjustable loft, lie and face angle system as described in detail in U.S. patent application Ser. No. 13/686,677 all of which is incorporated by reference it its entirety. For example, a portion of the sleeve 204, the sleeve bore 242, and the shaft collectively define a longitudinal axis 246 of the assembly. The hosel sleeve is effective to support the shaft along the longitudinal axis 246, which is offset from longitudinal axis 248 by offset angle 250. The sleeve can provide a single offset angle that can be between 0 degrees and 4 degrees, in 0.25 degree increments. For example, the offset angle can be 1.0 degree, 1.25 degrees, 1.5 degrees, 1.75 degrees, 2.0 degrees or 2.25 degrees.

In certain embodiments, the face insert 218 is adhesively or mechanically attached to the face insert support structure 216. In one embodiment, an epoxy adhesive such as 3M™ Scotch-Weld™ Epoxy Adhesive DP460 is utilized having a shore D hardness of about 75 to 84. In other embodiments, an epoxy adhesive such as 3M™ Scotch-Weld™ Epoxy Adhesive DP420 is utilized to attach the face insert 218 to the support structure 216. It is understood that numerous equivalent adhesives can be used to attach the face insert 218 to the support structure 216.

Figure 3:
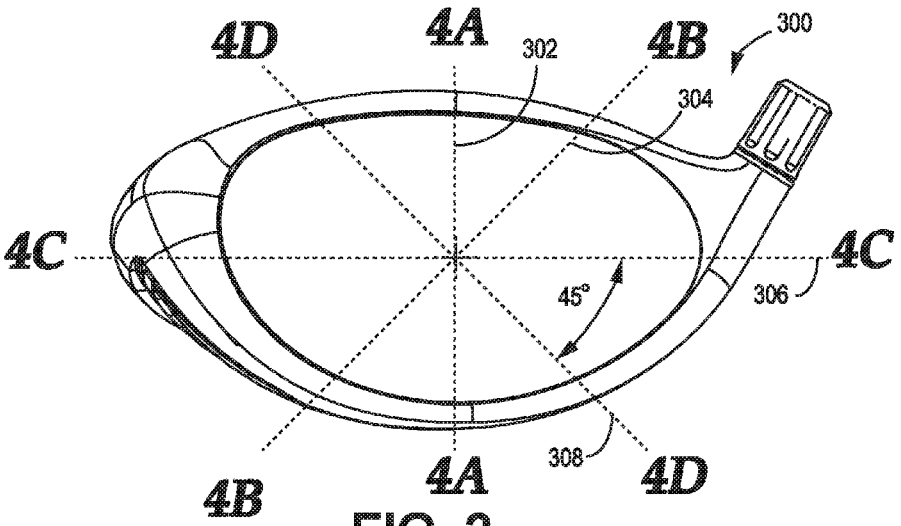
FIG. 3 is an elevated front view of a golf club head.

FIG. 3 illustrates a golf club head 300 of the same construction described in a lofted address position. Four cross-sectional planes, or major planes, have been taken along a vertical plane 302 (4A-4A), a forty-five degree plane 304 angled from the vertical plane toward the heel (4B-4B), a horizontal plane 306 sectional lines (4C-4C), and a forty-five degree plane 308 angled from the vertical plane toward the toe (4D-4D), as described in further detail below. All the cross sectional planes intersect at the geometric center of the golf club face as measured according to the USGA "Procedure for Measuring the Flexibility of a Golf Clubhead", Revision 2.0, Mar. 25, 2005. In FIG. 3, all the cross-section planes 302,304,306,308 are equiangular cross-sectional planes having a forty-five degree angle between each plane.

Figure 4A:
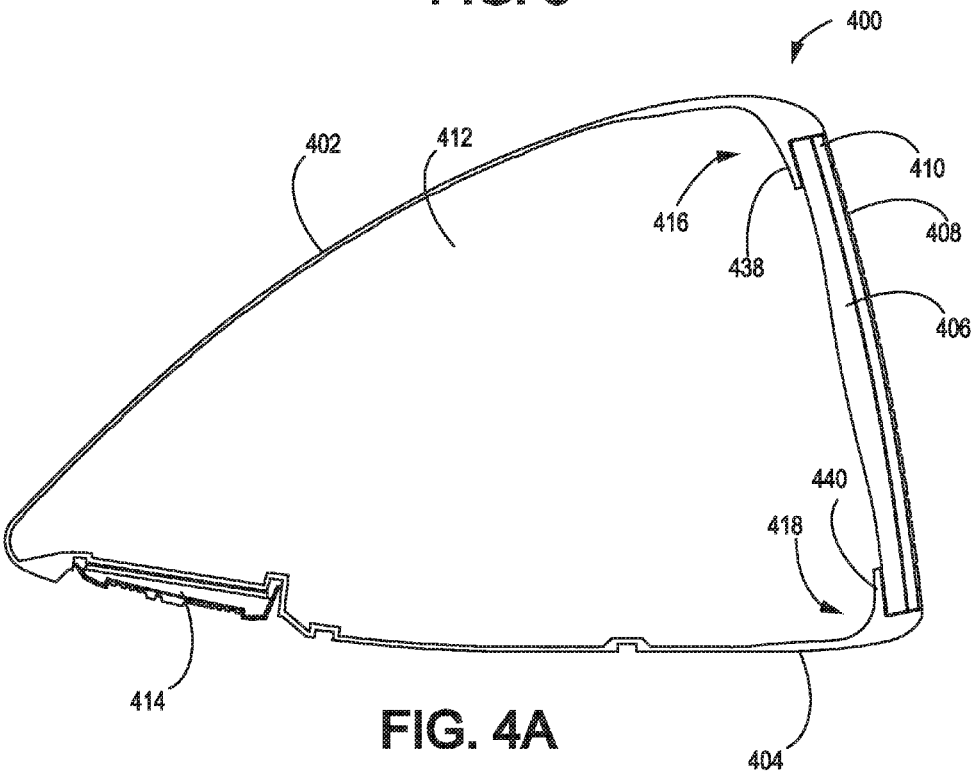
FIG. 4A is a cross-sectional view of the golf club head within the plane taken along section lines 4A-4A in FIG. 3.

FIG. 4A illustrates a cross-sectional profile view 400 of the golf club head taken along sectional lines 4A-4A in FIG. 3. For ease of illustration, the internal components and geometry of the golf club head outside of the vertical plane are not shown. The golf club head includes the composite face insert 406, a polymer coating layer 410, and a textured surface 408 on the polymer coating layer 410. The face insert 406 is supported by a rear support member 438,440. The rear support member 438,440 extends around the periphery of the golf club head face opening and includes an upper rear support member 438 (near the crown 402) and a lower rear support member 440 (near the sole 404). An interior volume 412 is enclosed by the golf club head. A badge 414 is also located on the exterior surface of the sole 404 of the golf club head.

FIG. 4A illustrates a design where the top support structure 416 and the bottom support structure 418 do not include an undercut region. A significant advantage of excluding an undercut region within the vertical plane 302 is to improve the durability of mis-hits that might occur at the intersection of the striking face and crown or striking face and sole. The non-undercut region is constructed with that same material that forms the entire support structure and rear supporting members.

Figure 4B:
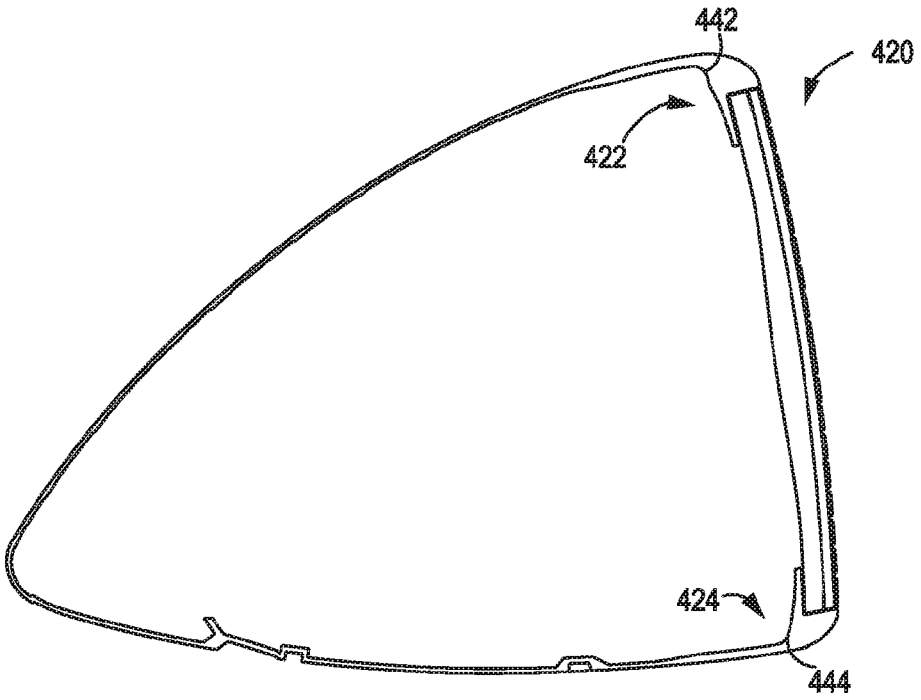
FIG. 4B is a cross-sectional view of the golf club head within the plane taken along section lines 4B-4B in FIG. 3.

FIG. 4B illustrates a cross-sectional profile view 420 of the golf club head taken along sectional lines 4B-4B in FIG. 3. As shown, the top support structure 422 includes an undercut region 442 within the upper region of the club head near the crown portion. In contrast, the lower support structure 424 includes a non-undercut region 444 within the lower region of the club head near the sole portion.

Figure 4C:
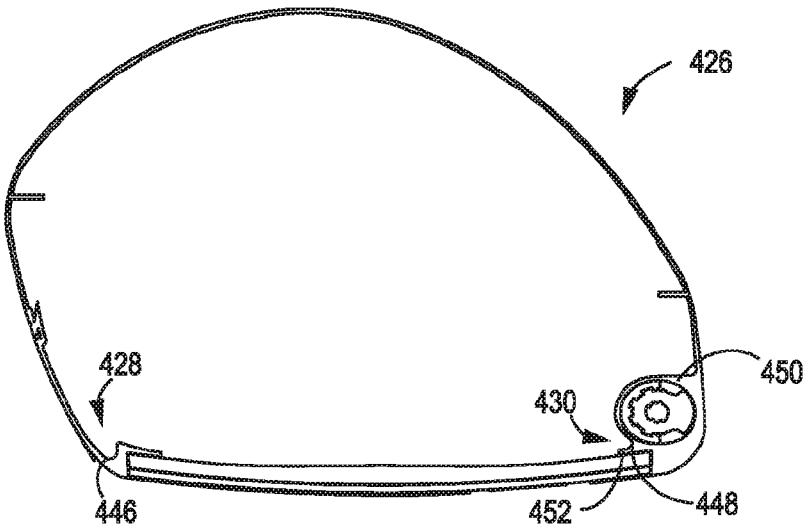
FIG. 4C is a cross-sectional view of the golf club head within the plane taken along section lines 4C-4C in FIG. 3.

FIG. 4C illustrates a cross-sectional profile view 426 of the golf club head taken along horizontal sectional lines 4C-4C in FIG. 3. The heel-side support structure 430 includes a non-undercut region 448 within the heel-side region of the club head. The heel-side rear support member 452 is integral with the internal hosel tube structure 450. The outer surface of the internal hosel tube structure 450 directly connects to the non-undercut region 448. The non-undercut region 448 extends toward the face away from the outer surface of the internal hosel tube structure 450 to form the heel-side rear support member 452. In contrast, the toe-side support structure 428 includes an undercut region 446 within the toe-side region of the club head. In one embodiment, the most aggressive undercut structure occurs on the toe-side of the club head due to the fact that structural failure is less likely to occur when a mishit occurs on the toe-side of the club head.

Figure 4D:
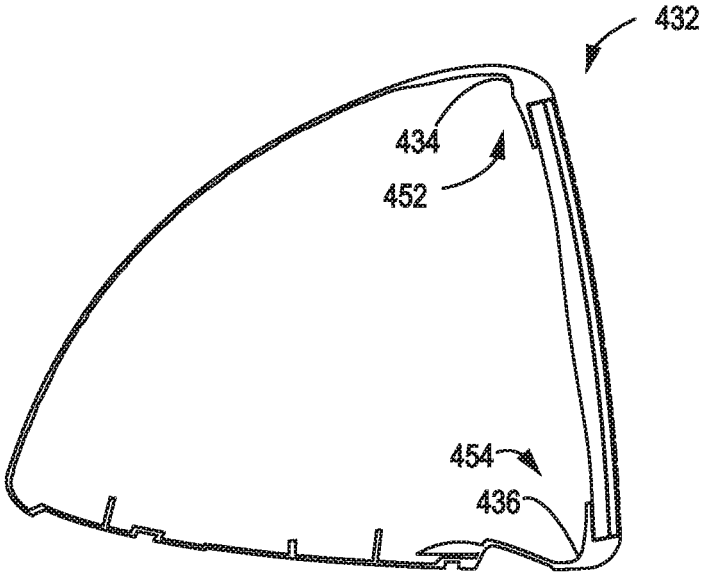
FIG. 4D is a cross-sectional view of the golf club head within the plane taken along section lines 4D-4D in FIG. 3.

FIG. 4D illustrates a cross-sectional profile view 432 of the golf club head taken along sectional lines 4D-4D in FIG. 3. The top support structure 452 includes an undercut region 434 within the upper region of the club head near the crown portion. In contrast, the lower support structure 454 includes a non-undercut region 436 within the lower region of the club head near the sole portion.

Figure 5:
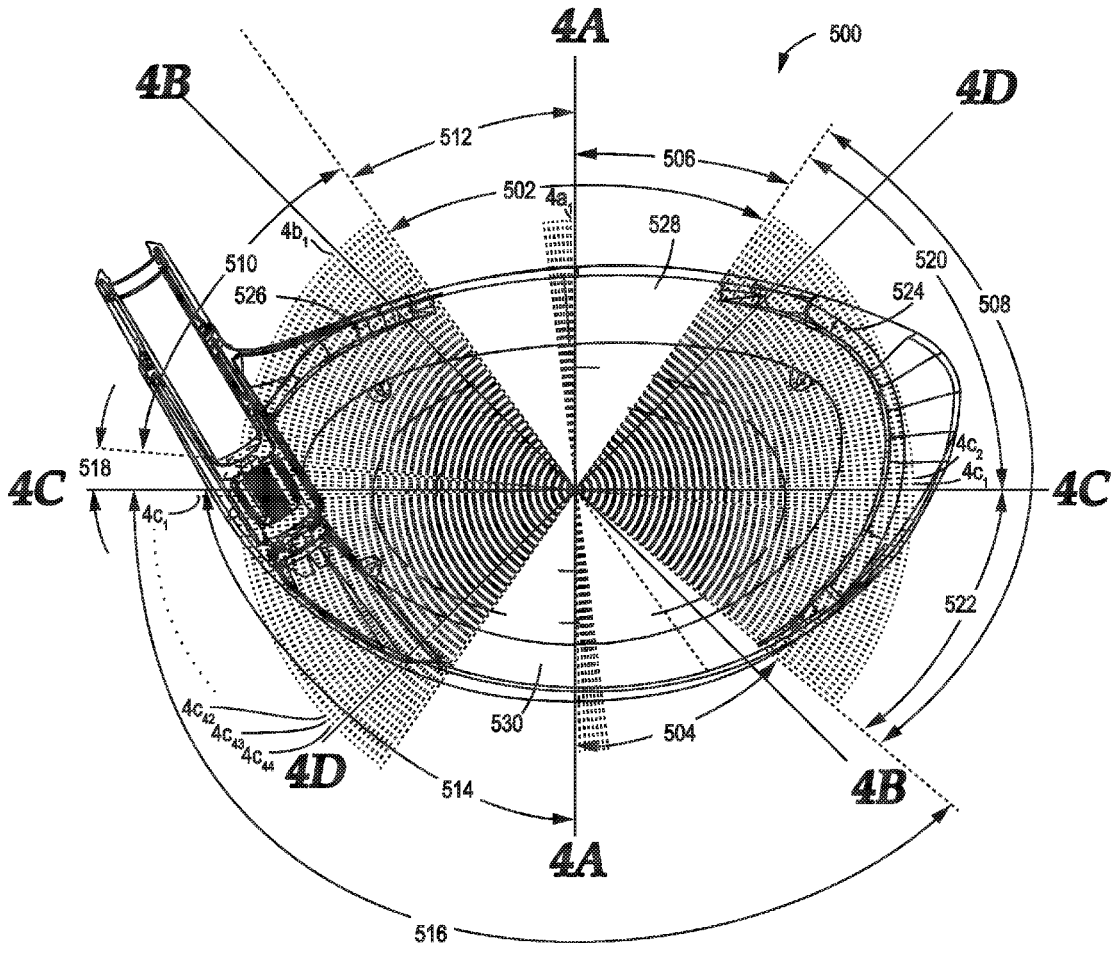
FIG. 5 is a cross-sectional view of an undercut and non-undercut structure taken along lines 5-5 in FIG. 1A.

FIG. 5 illustrates a golf club head 500 sectional view when taken along section lines 5-5 in FIG. 1A showing a rear portion of the striking face and insert. The golf club head 500 includes a toe undercut region 524 and a heel undercut region 526 as previously described in FIG. 2. The golf club head 500 is divided into by four equiangular planes that intersect at the geometric center of the face. In between each major plane 4A, 4B, 4C, 4D, individual minor planes are taken at every single degree between the major planes 4A, 4B, 4C, 4D. Major planes 4A and 4C divide the golf club head 500 into four quadrants being an upper toe quadrant, a lower toe quadrant, an upper heel quadrant, and a lower heel quadrant. Major plane 4C defines the dividing plane between the crown portion and the sole portion as described herein. Major plane 4A defines the dividing plane between the toe portion and the heel portion as described herein. Major plane 4D bisects the upper toe quadrant and lower heel quadrant at a forty five degree angle relative to the major plane 4A. Major plane 4B bisects the upper heel quadrant and lower toe quadrant at a forty five degree angle relative to major plane 4A. The major planes 4A, 4B, 4C, 4D define eight equiangular pie-shaped major regions.

FIG. 5 shows the undercut regions 524, 526 being located within at least five of the eight pie shaped major regions.

More specifically, the undercut regions occupy three pie shaped major regions on the toe-side and two pie shaped major regions on the heel-side. FIG. 5 also shows non-undercut regions 528, 530 that are located within seven out of the eight pie shaped major regions. The non-undercut regions 528, 530 occupy three pie shaped major regions on the crown-side and four pie shaped major regions on the sole-side.

In another embodiment, the undercut regions are located within one, two, three, four, six or seven out of the eight pie shaped major regions. The undercut regions may be located in the same number of pie shaped major regions when comparing the major regions of the toe-side with the major regions of the heel-side. For example, three major regions on the toe-side and three major regions on the heel said may contain an undercut region. In another embodiment, the non-undercut regions are located within one, two, three, four, five, or six out of the eight pie shaped major regions.

In the embodiment shown in FIG. 5, the major regions on the toe-side that contain an undercut region exceed the number of major regions on the heel-side that contain an undercut region.

In an alternative embodiment, the major regions on the heel-side that contain an undercut region exceed the number of major regions on the toe-side that contain an undercut region. The number of major regions that contain an undercut may be varied depending on the unique features of each club head and whether durability is a concern with regard to specific major regions.

Moving in a counter clock-wise direction, each subsequent minor plane is named according to the preceding major plane in addition to a numerical subscript. For example, the plane located at one degree from the major plane 4C in a counter clock-wise direction is plane $4C_1$. Subsequently, the plane located at two degrees from the major plane 4C in a counter clock-wise direction is plane $4C_2$. The same naming progression continues up through each degree of angle until major plane 4D is reached. For ease of illustration, the name for each individual minor plane is not illustrated in FIG. 5. In addition, some minor planes have been not shown in order to clearly show other important features. Each minor plane is named after the proceeding major plane with a subscript designating the number of degrees the minor plane is angled from the associated major plane. The subscripts of a minor plane can range from one to forty-four. Every cross-section within a major plane and minor plane is evaluated to determine whether an undercut portion exists in either the crown portion, toe portion, heel portion, or sole portion. In one embodiment, non-undercut portion exists in any major and minor planes within at least 35° on either side of the vertical major plane 4A. A toe-ward crown section angle 506 and a heel-ward crown section angle 512 do not have an undercut whatsoever. In one embodiment, the toe-ward crown section angle 506 and a heel-ward crown section angle 512 is about 35° each but can also be at least 5°, 10°, 15°, 20°, 25°, 30°, 40°, 45°, 50°, 60°, or 70°. As shown in FIG. 5, a crown-ward non-undercut zone or a first non-undercut zone 502 (which includes the heel-ward crown section angle 512 and toe-ward crown section angle 506) of a 70° section centered around the major plane 4A has no undercut in the crown portion. No undercut region exists in any crown portion of the club head within any plane between minor planes $4D_{55}$ and $4A_{35}$. In one embodiment, the non-undercut zone 502 is centered about the major vertical plane 4A but is located between 10° and 170°. In another embodiment, the non-undercut zone 502 is centered about the major vertical plane 4A and the non-undercut zone 502 is a continuous zone that creates a zone angle that is within a range of between 5° and 175°, or between 20° and 100°, or between 50° and 90°. The non-undercut zone 502 in the crown section can be present within a range of 5 to 175 major and minor planes, or between 20 and 100 major and minor planes, or between 50 and 90 major and minor planes. Of course, the non-undercut zone angle 502 does not need to be centered about the major plane 4A and can be offset by an offset angle of about 0°-45° from the major plane 4A relative to a centered position. In such a case, the offset angle would be measured from the major plane 4A to a bisecting plane that bisects the midpoint of the non-undercut zone.

FIG. 5 further illustrates an embodiment having two non-undercut zones in the crown portion 502, 518. The two non-undercut zones angles in the crown portion 502, 518 are spaced apart from one another by a heel-side undercut zone angle 510. In the embodiment shown, the heel-side undercut zone angle 510 is about 40° but can be a arrange of angles such as at least 5°, 10°, 15°, 20°, 25°, 30°, 45°, 50°, 60°, 70° or 80°.

FIG. 5 also illustrates a non-undercut zone 502, 518 angle in the crown-to-face transition portion that is not equal to the non-undercut zone 516 angle in the sole-to-face transition portion. The sole-ward non-undercut zone 516, or second non-undercut zone, can be continuous and create a zone having an angle between 5° and 175°, or between 20° and 140°, or between 50° and 90°. The sole-ward non-undercut zone 516 can include in 5 to 175 major and minor planes, or between 20 and 140 major and minor planes, or between 50 and 90 major and minor planes. Additionally, the toe-ward non-undercut sole section 504 and heel-ward non-undercut sole section 514 can be at least 5°, 10°, 15°, 20°, 25°, 30°, 40°, 45°, 50°, 60°, or 70° as measured from the major vertical plane 4A. The sole-ward non-undercut zone 516 is separated from the crown-ward non-undercut zone 502 by at least one or two undercut zones. The sole-ward non-undercut zone 516 and the crown-ward non-undercut zones 502, 518 are separated by the major plane 4C which creates the diving line between the crown and the sole.

FIG. 5 illustrates a toe-ward non-undercut sole section 504 to be about 50° and heel-ward non-undercut sole section 514 to be about 90°. Thus, the non-undercut zone 516 in the sole is about 140° but is not centered about the major vertical plane 4A. In one embodiment, the summation of non-undercut zone angles 502, 518 in the crown section are less than the non-undercut zone angle 516 in the sole section. In such an embodiment, the non-undercut zone angle 516 in the sole section and the non-undercut zone angle 502 in the crown section meet the following inequality:

$$\frac{\sum \text{Crown-Side No Undercut Zone Angle}}{\sum \text{Sole-Side No Undercut Zone Angle}} \leq 1 \qquad \text{Eq. 3}$$

Eq. 3 describes a non-undercut ratio between non-undercut zone angle(s) 502,518 in the crown portion (or summation, Σ, if more than one non-undercut zone in the crown exists) divided by the non-undercut zone angle 516 in the sole (or summation, Σ, if more than one non-undercut zone in the sole exists) being equal to or less than 1. It is understood that the above non-undercut regions can be a single non-undercut zone or a plurality of regions of non-undercut zones that are spaced apart by undercut zones. However, the summation of the non-undercut zones angles would meet the above ratios, angles, and criteria. In some embodiments, the crown-to-sole non-undercut ratio described in Eq. 3 can be between 0.05 and 0.95, between 0.10 and 0.90, between 0.20 and 0.80, between 0.30 and 0.70, or between 0.40 and 0.60.

Furthermore, in the exemplary embodiment shown in FIG. 5, the crown-to-sole non-undercut ratio, as described in Eq. 3, of about 0.79 is achieved. A first crown-side non-undercut zone angle 502 is about 70° is added with a second crown-side non-undercut zone angle 518 of about 5° to provide a total crown-side non-undercut zone angle 502, 518 of about 75°. The total crown-side non-undercut zone angle 502,518 divided by a sole-side non-undercut zone angle 516 of about 95° equals a non-undercut ratio of about 0.79.

In some embodiments, the crown-side non-undercut zone angle 502 in the crown is less than the sole-side non-undercut zone angle 516 in the sole. An advantage of a golf club constructed according to Eq. 3 would be that more mass filling the undercut region would be distributed lower in the club head and thereby lowering the overall center of gravity of the club head.

It is possible, in other embodiments, to have a golf club that meets the following inequality:

$$\frac{\sum \text{Crown-Side No Undercut Zone Angle}}{\sum \text{Sole-Side No Undercut Zone Angle}} > 1 \qquad \text{Eq. 4}$$

A golf club head that follows the ratio of Eq. 4 would have a larger angular non-undercut zone angle 502 in the crown (or summation, Σ) than the non-undercut zone angle 516 in the sole (or summation, Σ). A golf club head that is constructed according to Eq. 4 would have more mass filling the undercut region in the crown portion and thereby increasing the durability of the face-to-crown transition region during mis-hits that may impact this region of the golf club head. In some embodiments, the crown-to-sole non-undercut ratio described in Eq. 4 can be greater than or equal to 1.10, 1.20, 1.30, 1.40 or 1.50. In some embodiments, the crown-to-sole non-undercut ratio is between 1 and 20.

FIG. 5 further illustrates a toe-side undercut zone angle 508 that is about 95° but can be a arrange of angles such as at least 5°, 10°, 15°, 20°, 25°, 30°, 45°, 50°, 60°, 70° 80°, 100°,120°,140°,150°, or 170°. The toe-side undercut zone angle 508 is a continuous undercut that extends from a crown toe-side portion to a sole toe-side portion. The crown toe-side angle 520 of the undercut zone relative to the horizontal major plane 4C is about 55°. The sole toe-side angle 522 of the undercut zone relative to the major plane 4C is about 40°. In some embodiments, the crown toe-side angle 520 and the sole toe-side angle 522 can each be at least 5°, 10°, 15°, 20°, 25°, 30°, 40°, 45°, 50°, 60°, or 70°.

In one embodiment, the golf club head has a heel-to-toe undercut ratio that meets the following inequality:

$$\frac{\sum \text{heel-side undercut zone angle}}{\sum \text{toe-side undercut zone angle}} \leq 1 \qquad \text{Eq. 5}$$

A golf club head that meets Eq. 5 would have a larger toe-side undercut zone angle 508 than the heel-side undercut zone angle 510. Of course, if multiple undercut zones exist, a summation of undercut angles should be taken to determine whether a golf club head meets Eq. 5. Due to the removable shaft located on the heel-side of the club head, having a smaller heel side undercut zone angle would allow for more material to be available to support the internal hosel structure and ensure structural integrity. In some embodiments, the heel-to-toe undercut ratio described in Eq. 5 can be between 0.95 and 0.05, between 0.90 and 0.10, between 0.80 and 0.20, or between 0.70 and 0.30. For example, the undercut ratio can be 0.50, 0.40, 0.30, 0.20, or 0.10. The vertical major plane 4A creates a dividing line that defines whether an undercut or feature is located on the heel or the toe.

In one exemplary embodiment shown in FIG. 5, a heel-to-toe undercut ratio, as described above, of about 0.42 is achieved. A heel-side undercut zone angle 510 of 40° divided by a toe-side undercut zone angle 508 of 95° creates a heel-to-toe undercut ratio of about 0.42.

Figure 6:
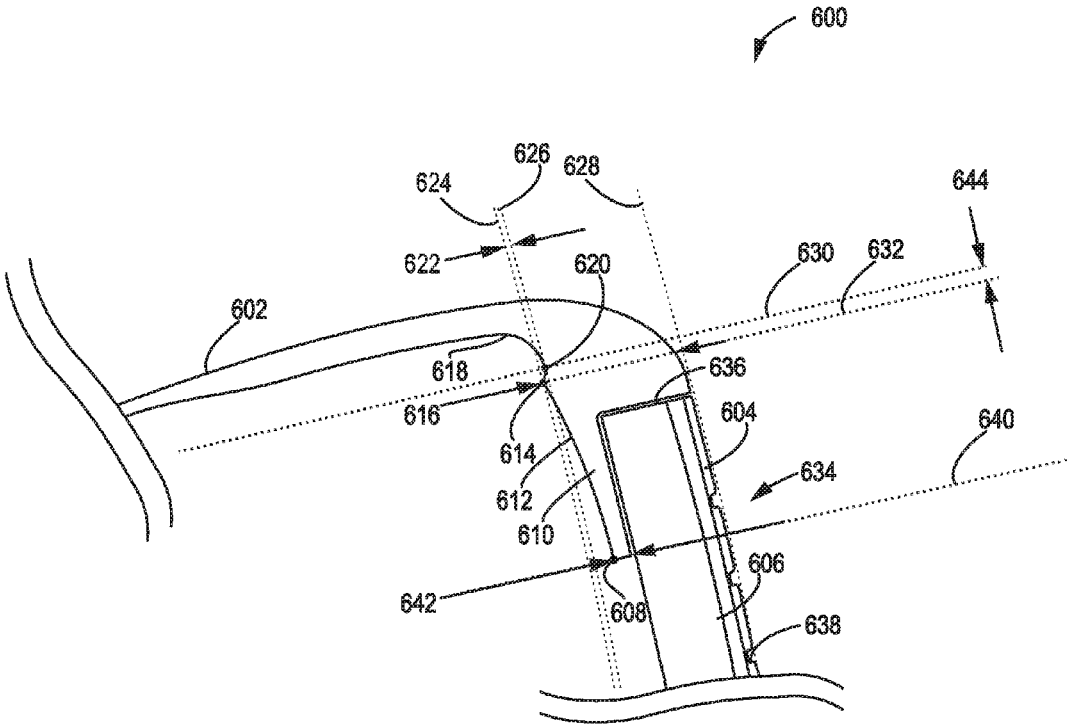
FIG. 6 is a detailed cross-sectional view of an undercut region.
Figure 7:
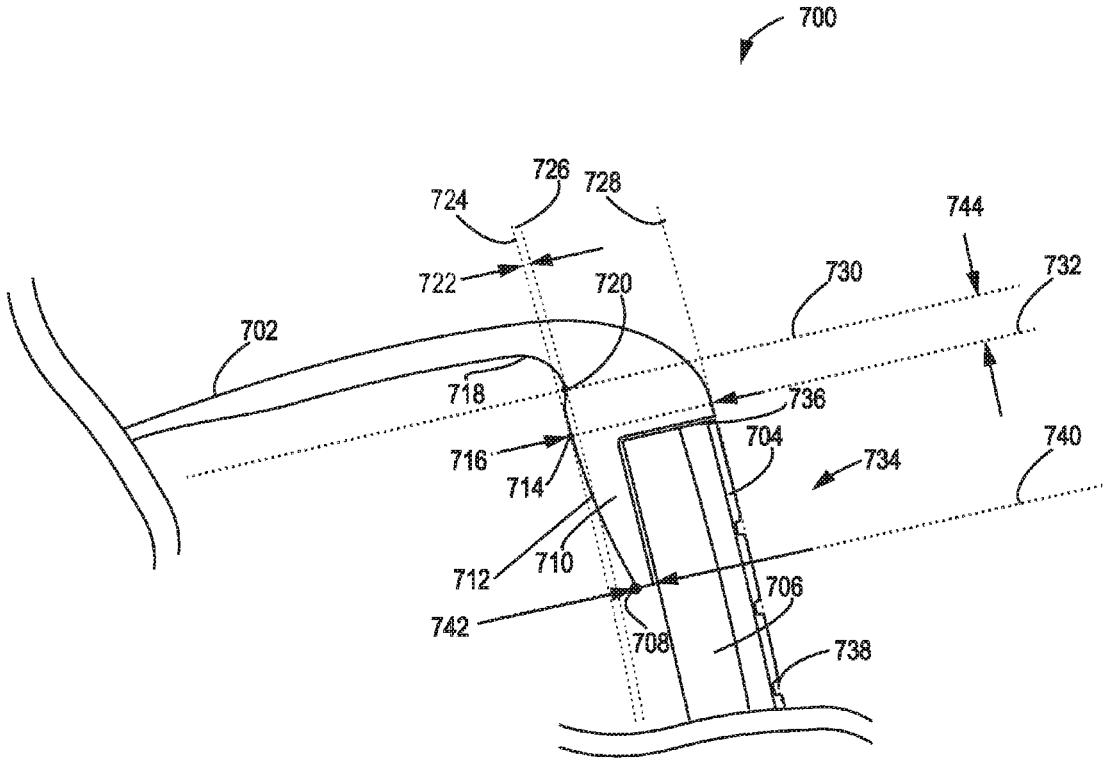
FIG. 7 is a detailed cross-sectional view of an undercut region, according to another embodiment.

In order to determine whether an undercut exists within the major and minor planes described above, a methodology is outlined with regard to FIGS. 6 and 7, as an example.

FIG. 6 illustrates a golf club head cross-sectional view 600 having a face insert 634 that includes a composite layer 606 having a side wall 636 portion. A cover layer 604 is attached to the composite layer 606 and can include score lines 638. In one embodiment, the cover layer 604 can be a polymer cover layer that attaches to the front surface of the composite layer 606. In another embodiment, the cover layer 604 can be a metallic titanium such as 6-4 titanium, 10-2-3 titanium, 15-3-3-3 titanium, 7-2 titanium, or commercially pure titanium. In certain embodiments, the cover layer 604 does not overlap with the side wall 636 of the composite layer 606. The side wall 636 engages either directly or indirectly with a peripheral wall of the support structure that receives the face insert 634. In other embodiments, the cover layer 604 acts as a cap where a wrap around portion of the cover layer 604 does overlap with the side wall 636 of the composite layer 606.

FIG. 6 further shows a rear support member 610, an apex point 614 on the interior surface contour 612, an undercut nadir 620, an interior body surface 618, an interior surface contour end point 608, an outer body surface 602, and a face curvature 628 that matches the curvature of the golf club head striking face at a given major or minor plane cross-section through the head. For example, if the cross-sectional view is through the major plane 4A, the face curvature 628 would be the roll curvature of the club head as measured according to the method outlined below. Similarly, if the cross-sectional view is taken through the major plane 4C, the face curvature 628 would be the bulge curvature of the club head as measured according to the method outlined below.

The method for determining the face curvature 628 within any major or minor plane consists of calculating three equidistant points fitted across a 1.5 inch curved segment along the surface of the face. The middle equidistant point is located in the middle of the 1.5 inch segment. The middle equidistant point is located at the face center location and a face curvature line is fitted through the three equidistant points. The face curvature described is a constant radius curvature between the three equidistant points and cannot be an arbitrary complex spline curvature.

FIG. 6 further shows an apex offset curvature 624 that is identical in orientation and curvature to the face curvature 628. However, the location of the apex offset curvature 624 is offset or spaced away from the face curvature 628 along a face normal vector 130. The apex offset curvature 624 is offset along the face normal vector 130 until the apex offset curvature 624 becomes tangent to an apex point 614 located on the interior surface contour 612. Similarly, a nadir offset curvature 626 is offset along the face normal vector 130 by an offset distance. The nadir offset curvature 626 is tangent to the undercut nadir point 620 as measured along the face normal vector 130 axis. An undercut distance 622 is defined between the nadir offset curvature 626 and the apex offset curvature 624 as defined along the face normal vector axis 130. If the undercut distance 622 is greater than zero (assuming a positive direction is along the face normal vector pointing away from the club head as shown in FIG. 1C), then an undercut is deemed to exist within the major or minor plane in question. In some embodiments, the undercut distance 622 is between 0-1 mm, 1-2 mm, 2-3 mm, 4-5 mm, 0-15 mm, 0-10 mm, or between 0-20 mm. In contrast, if the undercut distance 622 is non-existent, zero, or less (assuming a negative direction is along the face normal vector pointing toward the interior of the club head), then an undercut is deemed not to exist within the major or minor plane in question. In some instances, an undercut cannot be measured because no nadir point can be identified and therefore the undercut distance is deemed to be non-existent.

FIG. 6 further shows a nadir face normal axis 630 that passes through the nadir point 620. The nadir face normal axis 630 is parallel to the face normal vector 130 but passes through the nadir point 620 of the undercut instead of the face center. Likewise, an apex face normal axis 632 passes through the apex point 614 and is parallel to both the face normal vector 130 and the nadir face normal axis 630. An apex thickness 616 is measured along the apex face normal axis 632. In one example, the apex thickness is about 5.8 mm. In some embodiments, the apex thickness is between 5 mm and 6 mm, between 4 mm and 7 mm, or between 3 mm and 8 mm.

An undercut height 644 is defined as the distance between the apex face normal axis 632 and the nadir face normal axis 630 as measured along a direction perpendicular to both axis 630, 632. In some embodiments, the undercut height 644 is between 0-1 mm, 1-2 mm, 2-3 mm, 4-5 mm, 1-15 mm, 1-10 mm, or between 0-20 mm.

FIG. 6 also shows an end point face normal axis 640 that passes through the interior surface contour end point 608 and is also parallel to the face normal vector 130. The thickness of the rear support member 642 at the end point 608 (i.e. end point thickness) is measured along the end point face normal axis 640. In the embodiment shown, the end point thickness 642 is less than the apex thickness 616. In one example, the end point thickness 642 is about 1 mm. In some embodiments, the end point thickness 642 is between 0.2 mm and 2 mm, or between 0.5 mm and 1.5 mm.

An adhesive is disposed between the face insert 634 and the face insert rear support member 610. A bond gap is provided between the rear support member 610 and a rear surface of the composite face 606 where the adhesive material fills the bond gap. In certain embodiments, the bond gap is less than about 0.8 mm or less than about 0.2 mm. In a preferred embodiment, the bond gap is about 0.15 mm or less. In the exemplary embodiment of FIG. 6, the cover layer 604 includes an outer edge that is generally coplanar with the edge of the composite face 606. In other words, the cover layer 604 does not include a return side wall portion.

FIG. 7 illustrates another exemplary embodiment having of a golf club head cross-sectional view 700 having a face insert 734 that includes a composite layer 706 having a side wall 736 portion. A cover layer 704 is attached to the composite layer 706 and can include score lines 738. FIG. 7 further shows a nadir point 720, an apex point 714, an interior surface contour end point 708, an interior surface contour 712, a rear support member 710, an outer body surface 702, an interior body surface 718, an apex offset curvature 724, a nadir offset curvature 726, a face curvature 728, a nadir face normal axis 730, an apex face normal axis 732, an undercut height 744, an undercut distance 722, an apex thickness 716, an endpoint thickness 742, and an endpoint face normal axis 740. The embodiment of FIG. 7 is similar to the embodiment of FIG. 6 except that the interior surface contour 712 is a different shape and geometric contour. The interior surface contour 712 of FIG. 7 is an inwardly bulging surface that is convex relative to the interior of the club head. In contrast, the interior surface contour 612 of FIG. 6 is a concave surface relative to the interior of the club head. The shape of the interior surface contour 712, 612 impacts where the apex point 714, 614 occurs and thus impacts whether an undercut distance 622, 722 greater than zero is deemed to exist within a given major or minor axis. The location of the apex point 714, 614 also impacts the value of the undercut height 644, 744. Irrespective of the shape of the interior surface contour 712, 612, the same methodology outlined above will be used to determine whether an undercut distance 622, 722 exists within a given major or minor axis.

The overall club head weight is about 190 g to about 210 g or between 180 g and 250 g. The club head of the embodiments described herein can have a mass of about 200 g to about 210 g or about 190 g to about 200 g. In certain embodiments, the total mass of the golf club head is between 185 g and 215 g or between about 194 g and 205 g. Additional mass added by the undercut fill material, such as titanium, will have an effect on moment of inertia and center of gravity values as shown in Tables 1 and 2.

Table 1 illustrates exemplary MOI that can be achieved by the embodiments described herein.

TABLE 1

| $I_{CGx}$ (kg · mm$^2$) | $I_{CGy}$ (kg · mm$^2$) | $I_{CGz}$ (kg · mm$^2$) |
|---|---|---|
| 180 to 300 | 290 to 330 | 390 to 410 |
| 170 to 310 | 280 to 340 | 380 to 420 |
| 160 to 320 | 270 to 350 | 370 to 430 |

The embodiments described conform with the U.S.G.A. Rules of Golf and in some examples the $I_{CGz}$ is less than 590 kg·mm$^2$ plus a test tolerance of 10 kg·mm$^2$. In similar embodiments, the moment of inertia about the CG x-axis (toe to heel), the CG y-axis (back to front), and CG z-axis (sole to crown) is defined. In certain implementations, the club head can have a moment of inertia about the CG z-axis, between about 450 kg·mm$^2$ and about 650 kg·mm$^2$, and a moment of inertia about the CG x-axis between about 300 kg·mm$^2$ and about 500 kg·mm$^2$, and a moment of inertia about the CG y-axis between about 300 kg·mm$^2$ and about 500 kg·mm$^2$.

Table 2 illustrates exemplary CG location coordinates with respect to the origin point axes.

TABLE 2

| CGX origin x-axis coordinate (mm) | CGY origin y-axis coordinate (mm) | CGZ origin z-axis coordinate (mm) |
|---|---|---|
| 2.8 to 4.5 | 27 to 32 | −1 to −4 |
| 2.5 to 5.0 | 22 to 37 | −0.5 to −5 |
| 2 to 6 | 20 to 40 | 1 to −8 |

The non-undercut regions of the face support area described herein are a solid single piece casting that may have a negative impact on CG location. However, the negative impact on CG location is far outweighed by the durability benefits and performance benefits achieved by having some regions of the face support structure having an undercut while strategically selecting other regions to be without an undercut (as measured according to the methodology outlined above). In certain embodiments, the CG x-axis coordinate is between approximately −5 mm and approximately 10 mm, a CG y-axis coordinate is between approximately 20 mm and approximately 50 mm, and a CG z-axis coordinate between approximately −10 mm and approximately 5 mm.

One advantage of the present invention is that a strategically designed undercut and non-undercut support region is provided that increases the durability of the club head while maintaining some flexibility and performance.

In addition, the non-undercut structures described herein prevent unwanted stress concentrations to the crown, sole, or body of the club head. Therefore, large transfer forces through the non-undercut structures are less likely to cause mechanical failure.

Furthermore, a significant advantage of the present invention is that an adjustable shaft system that adjusts loft, lie, or face angle is implemented in a single golf club head having strategically placed non-undercut and undercut regions to ensure durability while maintaining performance characteristics.

In similar embodiments, the volume of the golf club head as measured according to the USGA rules is between 390 cc and about 475 cc, or between about 410 cc and 470 cc, or between about 400 cc to about 475 cc, or greater than 400 cc. In certain embodiments, the coefficient of restitution is greater than 0.80 or 0.81 or between about 0.81 and 0.83 as measured according to the USGA rules of golf. Furthermore, the COR in the club heads of the present invention are between 0.80 and 0.81, or between 0.81 and 0.82, or between 0.82 and 0.83, or between 0.83 and 0.85. In some cases, a COR is achieved between 0.80 and 0.85. In addition, in some embodiments, the characteristic time is greater than 230 μs or 220 μs or between about 230 μs and 257 μs as measured according to the USGA rules.

The golf club head has a head origin defined as a position on the face plane at a geometric center of the face. The head origin includes an x-axis tangential to the face and is generally parallel to the ground when the head is in an address position. At the address position, a positive x-axis extends towards the heel portion and a y-axis extends perpendicular to the x-axis and is generally parallel to the ground. A positive y-axis extends from the face and through the rearward portion of the body and a z-axis extends perpendicular to the ground, to the x-axis and to the y-axis when the head is ideally positioned. Furthermore, a positive z-axis extends from the origin and generally upward.

In the metal-wood embodiments described herein, the "face size" or "face area" or "striking surface area" of "face size surface area" is defined according to a specific procedure described herein. A front wall extended surface 806 is first defined which is the external face surface that is extended outward (extrapolated) using the average bulge radius (heel-to-toe) and average roll radius (crown-to-sole). The bulge radius, for purposes of measuring face size only (not undercut and face curvature as described above), is calculated using five equidistant points of measurement fitted across a 2.5 inch segment along the surface of the face as projected from the x-axis (symmetric about the center point). The roll radius is calculated by three equidistant points fitted across a 1.5 inch segment along the surface of the face as projected from the y-axis (also symmetric about the center point).

The front wall extended surface 806 is then offset by a distance of 0.5 mm towards the center of the head in a direction along an axis that is parallel to the face surface normal vector at the center of the face. The center of the face is defined according to USGA "Procedure for Measuring the Flexibility of a Golf Clubhead", Revision 2.0, Mar. 25, 2005.

Figure 8A:
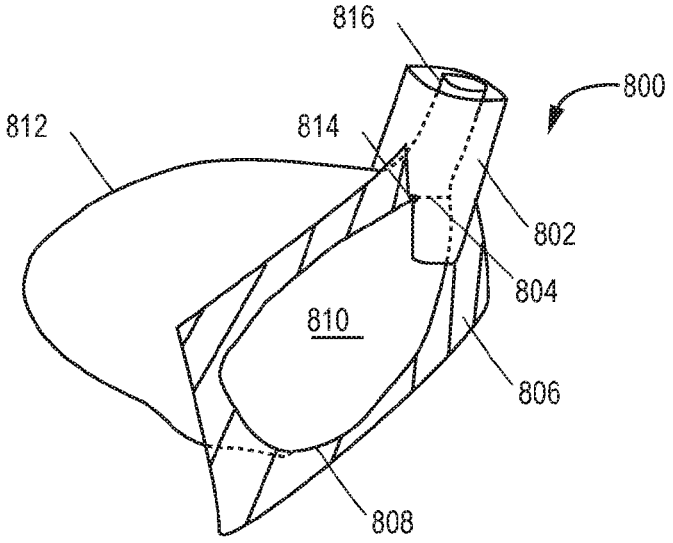
FIG. 8A illustrates a method of measuring face size.
Figure 8B:
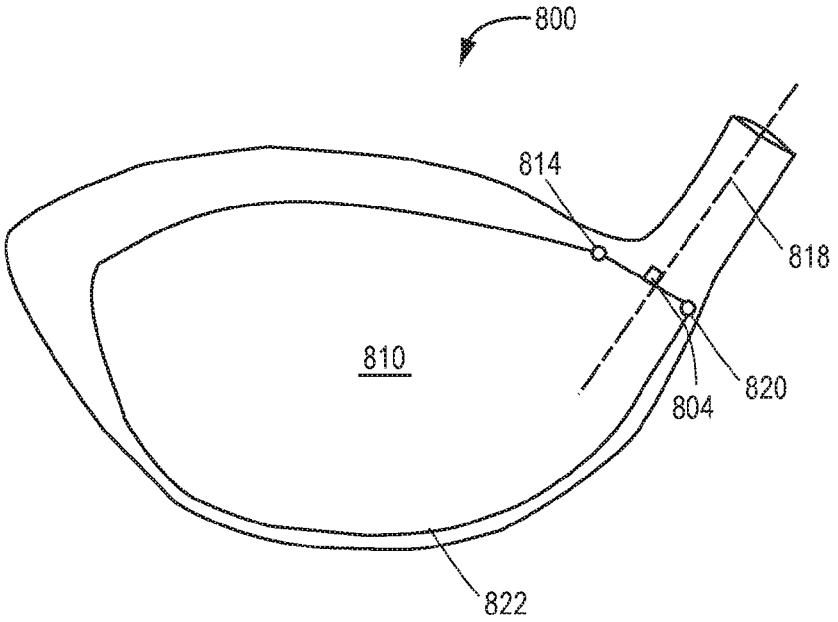
FIG. 8B illustrates a method of measuring face size to exclude the hosel portion surface area.

FIG. 8A illustrates the front wall extended surface 806 after it has been offset by the 0.5 mm distance. A face front wall profile shape curve 808 is defined at the intersection of the external surface of the head 800 with the offset front wall extended surface 806. A cylindrical section 802 is also defined having a 30 mm diameter cylindrical surface that is co-axial with the shaft or hosel axis. The intersection of the face front wall profile shape curve 808 with the cylindrical section 802 occurs at a first intersection point 814. Furthermore, a sectioning line 804 is drawn from the first intersection point 814 along the surface of the club in a direction normal to the hosel axis 818. The section line 804 then intersects a second intersection point 820 that represents the intersection of the front wall profile shape curve 808 with the section line 804 as it is extended in a direction normal to the hosel axis. A hosel trimmed front wall profile shape curve 822 is then created as seen in FIG. 8B. The hosel trimmed front wall profile shape curve 822 is defined by a portion of the front wall profile shape curve 808 and the section line 804 as it extends between the first intersection point 814 and the second intersection point 820. The hosel trimmed front wall profile shape curve 822 contains a first area 810.

A front wall plane is then defined as a plane which is tangent to the face surface at the geometric center of the face using the method defined in Section 6.1 of the USGA Procedure for Measuring the Flexibility of a Golf Clubhead (Revision 2.0 Mar. 25, 2005).

Figure 8C:
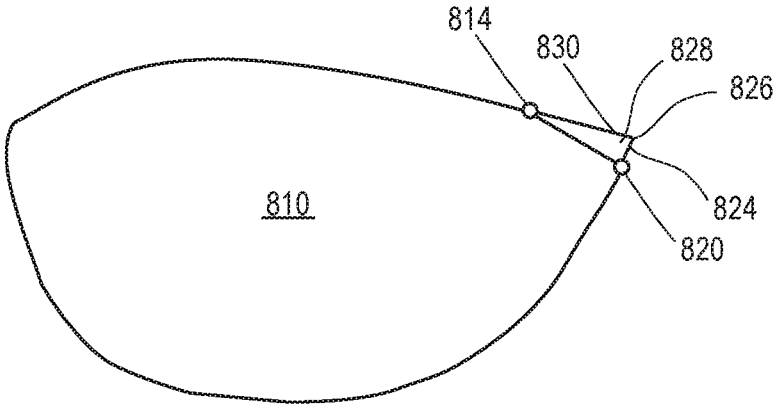
FIG. 8C illustrates a face surface area projected on to a plane.

The hosel trimmed front wall profile shape curve 822 is then projected onto the front wall plane, which is a two dimensional surface plane. Subsequently, the projection of the hosel trimmed front wall profile shape curve 822 on the front wall plane is modified to find the final face area as defined herein. Specifically, in the projection plane at the first intersection point 814 and the second intersection point 820, a tangent line 830, 824 is drawing tangent to the hosel trimmed front wall profile shape curve 822 (as projected on the front plane) at the intersection points 814, 820 until the tangent lines 830, 824 intersect each other at a vertex 826, as seen in FIG. 8C. These two tangent lines 830, 824 and the remaining hosel trimmed front wall profile shape curve 822 together define the "face size" or "face size surface area" as discussed above. In other words, the two tangent lines 830,824 create a second area 828 which is added to the first area 810 (as projected on a plane) to create the final face size or face size surface area, as seen in FIG. 8C.

In certain embodiments, the striking surface has a surface area between about 4,500 $mm^2$ and 6,200 $mm^2$ and, in certain preferred embodiments, the striking surface is at least about 5,000 $mm^2$ or between about 5,300 $mm^2$ and 6,900 $mm^2$ or between about 5,000 $mm^2$ and 7,000 $mm^2$. In some embodiments, the face size surface area includes a metallic material and a composite material which are both located on the front portion of the club head and are within a face size surface area region.

In order to achieve the desired face size, mass is removed from the crown material so that the crown material is between about 0.4 mm and 0.8 mm or between 0.4 mm and 0.7 mm over at least 50% of the crown surface area.

In certain embodiments, the club head height is between about 63.5 mm to 71 mm (2.5" to 2.8") and the width is between about 116.84 mm to about 127 mm (4.6" to 5.0"). Furthermore, the depth dimension is between about 111.76 mm to about 127 mm (4.4" to 5.0"). The club head height, width, and depth are measured according to the USGA rules.

In view of the many possible embodiments to which the principles of the disclosed invention may be applied, it should be recognized that the illustrated embodiments are only preferred examples of the invention and should not be taken as limiting the scope of the invention. It will be evident that various modifications may be made thereto without departing from the broader spirit and scope of the invention as set forth. The specification and drawings are, accordingly, to be regarded in an illustrative sense rather than a restrictive sense.

We claim:

1. A golf club head comprising:

a club head body having an external surface with a heel portion, a toe portion, a crown portion, a sole portion, and a front opening;

a face insert support structure located at the front opening, the support structure including a rear support member, the rear support member having a support portion interior surface contour defining an apex point and an undercut distance in an undercut region within at least one major or minor plane;

a face insert attached at the front opening and closing the front opening of the body; and at least one non-undercut region located in at least one major or minor plane intersecting a crown to face transition region;

at least one undercut region;

wherein the non-undercut region is located substantially in a sole region and creates a first non-undercut zone having a first zone angle that is between 5° and 175°.

2. The golf club head of claim 1, wherein the golf club head has a coefficient of restitution of at least 0.79 and a characteristic time of less than at least 257 μs.

3. The golf club head of claim 1, including a second non-undercut region that is located substantially in a crown region and creates a non-undercut zone having a zone angle that is between 5° and 175°.

4. The golf club head of claim 1, wherein the golf club head has a weight of between 185 g and 215 g, and the non-undercut region is centered about a major vertical plane.

5. The golf club head of claim 4, wherein the volume of the golf club head is between 400 cc and 475 cc.

6. The golf club head of claim 1, wherein a CG x-axis coordinate is between −5 mm and 10 mm, a CG y-axis coordinate is between 20 mm and 50 mm, and a CG z-axis coordinate is between −10 mm and 5 mm, and the rear support member includes a heel-side rear support member that is integral with an internal hosel tube structure.

7. The golf club head of claim 6, wherein a moment of inertia about the golf club head CG z-axis is between 370 $kg \cdot mm^2$ and 430 $kg \cdot mm^2$, a moment of inertia about the golf club head CG x-axis is between 160 $kg \cdot mm^2$ and 320 $kg \cdot mm^2$, and a moment of inertia about the golf club head CG y-axis is between 270 $kg \cdot mm^2$ and 350 $kg \cdot mm^2$.

8. The golf club head of claim 1, wherein the undercut distance is between 0 mm and 20 mm.

9. The golf club head of claim 8, wherein an undercut height is between 1 mm and 20 mm.

10. A golf club head comprising:

a club head body having an external surface with a heel portion, a toe portion, a crown portion, a sole portion, and a front opening;

a face insert support structure located at the front opening, the support structure including a rear support member, the rear support member having a support portion interior surface contour defining an apex point and an undercut distance in an undercut region within at least one major or minor plane;

a face insert attached at the front opening and closing the front opening of the body; and at least one non-undercut region and one undercut region located in at least one major or minor plane intersecting a crown to face transition region;

wherein a CG x-axis coordinate is between −5 mm and 10 mm, a CG y-axis coordinate is between 20 mm and 50 mm, and a CG z-axis coordinate is between −10 mm and 5 mm.

11. The golf club head of claim 10 wherein the volume of the golf club head is between 400 cc and 475 cc.

12. The golf club head of claim 10 wherein a CG x-axis coordinate is between −5 mm and 10 mm, a CG y-axis coordinate is between 20 mm and 50 mm, and a CG z-axis coordinate is between −10 mm and 5 mm, and the rear support member includes a heel-side rear support member that is integral with an internal hosel tube structure.

13. The golf club head of claim 10 wherein an undercut height is between 1 mm and 20 mm.

14. A golf club head comprising:

a club head body having an external surface with a heel portion, a toe portion, a crown portion, a sole portion, and a front opening;

a face insert support structure located at the front opening, the support structure including a rear support member, the rear support member having a support portion interior surface contour defining an apex point and an undercut distance in an undercut region within at least one major or minor plane;

a face insert attached at the front opening and closing the front opening of the body, wherein four major planes intersect at a geometric center point of the face insert creating eight pie shaped major regions; and at least one undercut region, wherein the undercut region is located within at least two of the eight pie shaped major regions.

15. The golf club head of claim 14 wherein the undercut region is located with at least five of the eight pie shaped major regions.

16. The golf club head of claim 15 further including at least one non-undercut region located adjacent to each undercut region.

17. The golf club head of claim 14 wherein the undercut region is located within at least two of the eight pie shaped regions on the toe portion and within at least two of the eight pie shaped regions on the heel portion.

18. The golf club head of claim 14 wherein the golf club head has a coefficient of restitution of at least 0.79 and a characteristic time of less than at least 257 μs.

19. The golf club head of claim 14 wherein the volume of the golf club head is between 400 cc and 475 cc.

* * * * *